US006301728B1

(12) United States Patent
Pilatowicz et al.

(10) Patent No.: US 6,301,728 B1
(45) Date of Patent: Oct. 16, 2001

(54) QUICK-INSTALL ASSEMBLY FOR A SINGLE CONTROL FAUCET

(75) Inventors: Edward J. Pilatowicz, Woodland Hills; Oscar Romero, Granada Hills, both of CA (US)

(73) Assignee: Emhardt Inc., Newark, DE (US)

( * ) Notice: Subject to any disclaimer, the term of this patent is extended or adjusted under 35 U.S.C. 154(b) by 0 days.

(21) Appl. No.: 09/631,268

(22) Filed: Aug. 2, 2000

(51) Int. Cl.[7] ..... E03C 1/042

(52) U.S. Cl. ..... 4/695; 4/677; 4/675; 137/360; 137/801

(58) Field of Search ..... 4/695, 675, 677, 4/678, 670; 137/359, 801, 360; 403/408.1, 409.1, 374.1, 373

(56) References Cited

U.S. PATENT DOCUMENTS

| | | | |
|---|---|---|---|
| 2,916,540 | 12/1959 | Rostan . | |
| 4,281,857 | 8/1981 | Randall . | |
| 4,553,277 | 11/1985 | Duncan . | |
| 4,760,861 | 8/1988 | Botnick . | |
| 4,848,395 | 7/1989 | Krippendorf . | |
| 4,998,555 | 3/1991 | Barhydt, Sr. et al. . | |
| 5,127,427 | 7/1992 | Kajpust et al. . | |
| 5,388,287 | 2/1995 | Tischler et al. . | |
| 5,465,749 | 11/1995 | Sauter et al. . | |
| 5,515,882 | 5/1996 | Hennis . | |
| 5,865,211 | 2/1999 | Thomas . | |
| 5,946,746 | 9/1999 | Bloom . | |
| 5,983,917 | 11/1999 | Thomas . | |
| 6,076,445 * | 6/2000 | Kenyon et al. | 403/408.1 |

FOREIGN PATENT DOCUMENTS

| | | | |
|---|---|---|---|
| 220731-A * | 1/1990 | (JP) | 4/678 |
| 406264479-A * | 9/1994 | (JP) | 4/695 |

* cited by examiner

*Primary Examiner*—Steven O. Douglas
*Assistant Examiner*—Khoa Huynh
(74) *Attorney, Agent, or Firm*—Richard J. Veltman; John D. Del Ponti

(57) ABSTRACT

A quick-install assembly for a single control faucet connected to water supply lines that extend through an opening in a deck to which the faucet is mounted, which assembly has a collar of larger diameter than the diameter of the opening of the deck and positioned from above the deck to be disposed at the opening of the deck. The collar has a pair of ears formed thereon that extend over the opening in the deck. A pair of fasteners are operatively engaged from above the deck to be threadedly connected to the ears to be disposed from above through the opening of the deck. A retainer is threadedly connected to the fasteners and includes a pair of swing flaps thereon adapted to be axially shifted toward and away from the collar responsive to the direction of rotation of the fasteners. The pair of swing flaps rotate on the fasteners between a closed position that provides a small dimension that passes through the opening of the deck and an open position that provides a long dimension with each swing flap pivoted outwardly so that when the retainer is disposed below the deck and the retainer is shifted upwardly each of the swing flaps will clamp against the underside of the deck to clamp the quick-install assembly thereto. Lastly, connecting device are operable from above the deck to connect the faucet to the collar whereby the faucet will be mounted upon the deck.

10 Claims, 12 Drawing Sheets

QUICK-INSTALL ASSEMBLY FOR A SINGLE CONTROL FAUCET

BACKGROUND OF THE INVENTION

This invention relates to a quick-install assembly for a single control faucet in which the assembly is mounted to the deck from above and, thereafter, the faucet is affixed thereto also from above the deck. Since all the fasteners are operated on from above the deck, the tight quarters and limited space below the deck are avoided.

SUMMARY OF THE INVENTION

In the prior art, faucet assemblies were conventionally connected to the deck, partially or wholly, from the underside of the deck. Accordingly, the necessary underside assembly was made from an awkward position and usually in tight quarters having limited accessibility, and often required special tools.

It is an object of the present invention to avoid the difficulties of the prior art assembly from the underside of the deck by having the assembly made wholly from the topside of the deck. It is another object of the present invention to provide a faucet assembly from the topside of the deck that is simple to make, economical to produce and highly reliable. It is another object of the present invention to provide a faucet assembly that permits the faucet to be both connected and disconnected wholly from the topside of the deck.

It is still another object of the present invention to provide a faucet assembly that is quick and easy, and that requires a minimum of tools and operations, which can be complete by both skilled and unskilled operators.

Further areas of applicability of the present invention will become apparent from the detailed description provided hereinafter. It should be understood, however, that the detailed description and specific examples—while indicating preferred embodiments of the invention—are intended for purposes of illustration only, since various changes and modifications within the spirit and scope of the invention will become apparent to those skilled in the art from this detailed description.

BRIEF DESCRIPTION OF THE ACCOMPANYING DRAWINGS

The present invention will become more fully understood from the detailed description and the accompanying drawings, wherein.

DETAILED DESCRIPTION OF THE INVENTION

Figure 1:
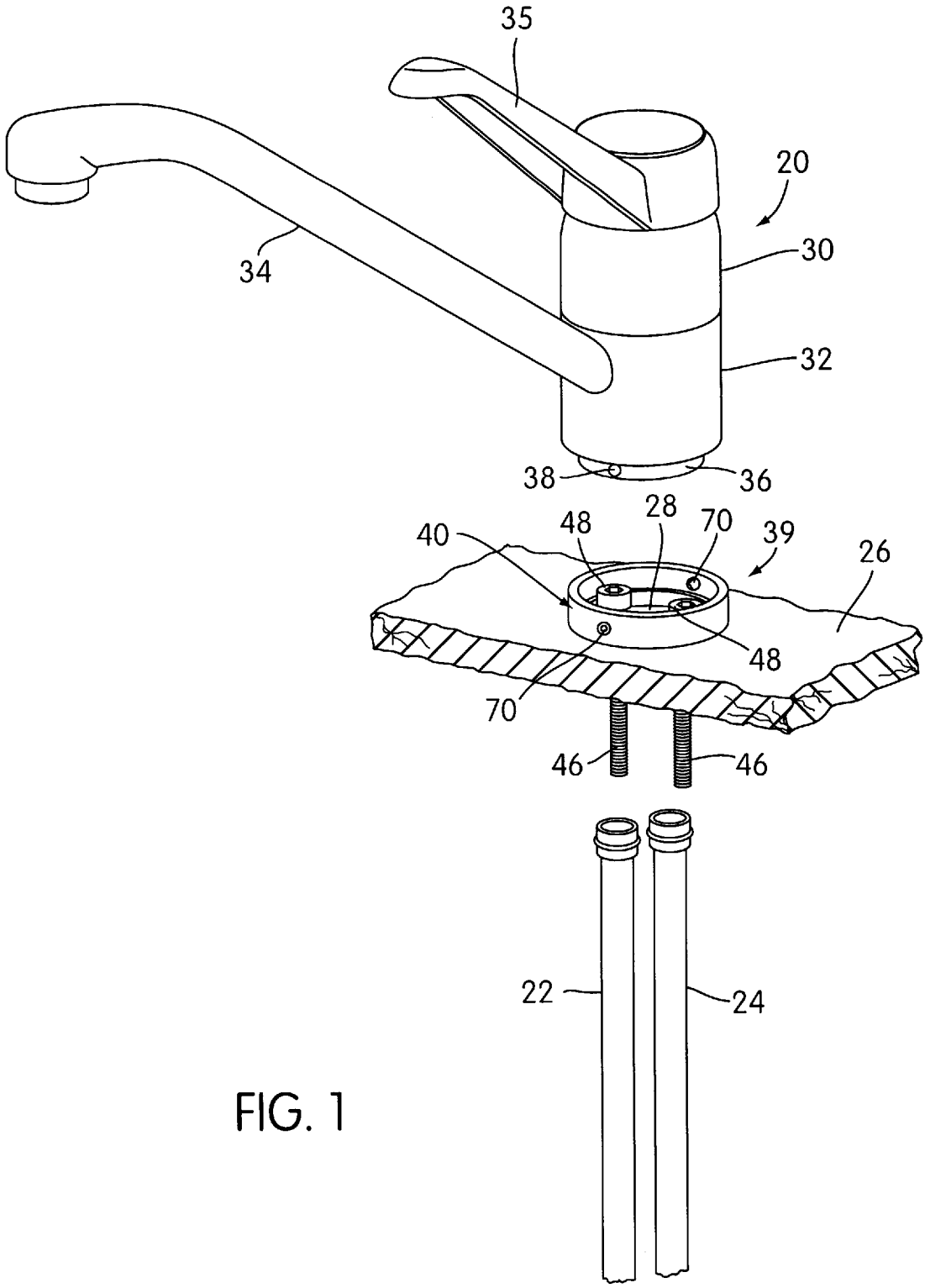
FIG. 1 is an exploded perspective view of a first embodiment of the quick-install assembly according to the principle of the present invention.
Figure 2:
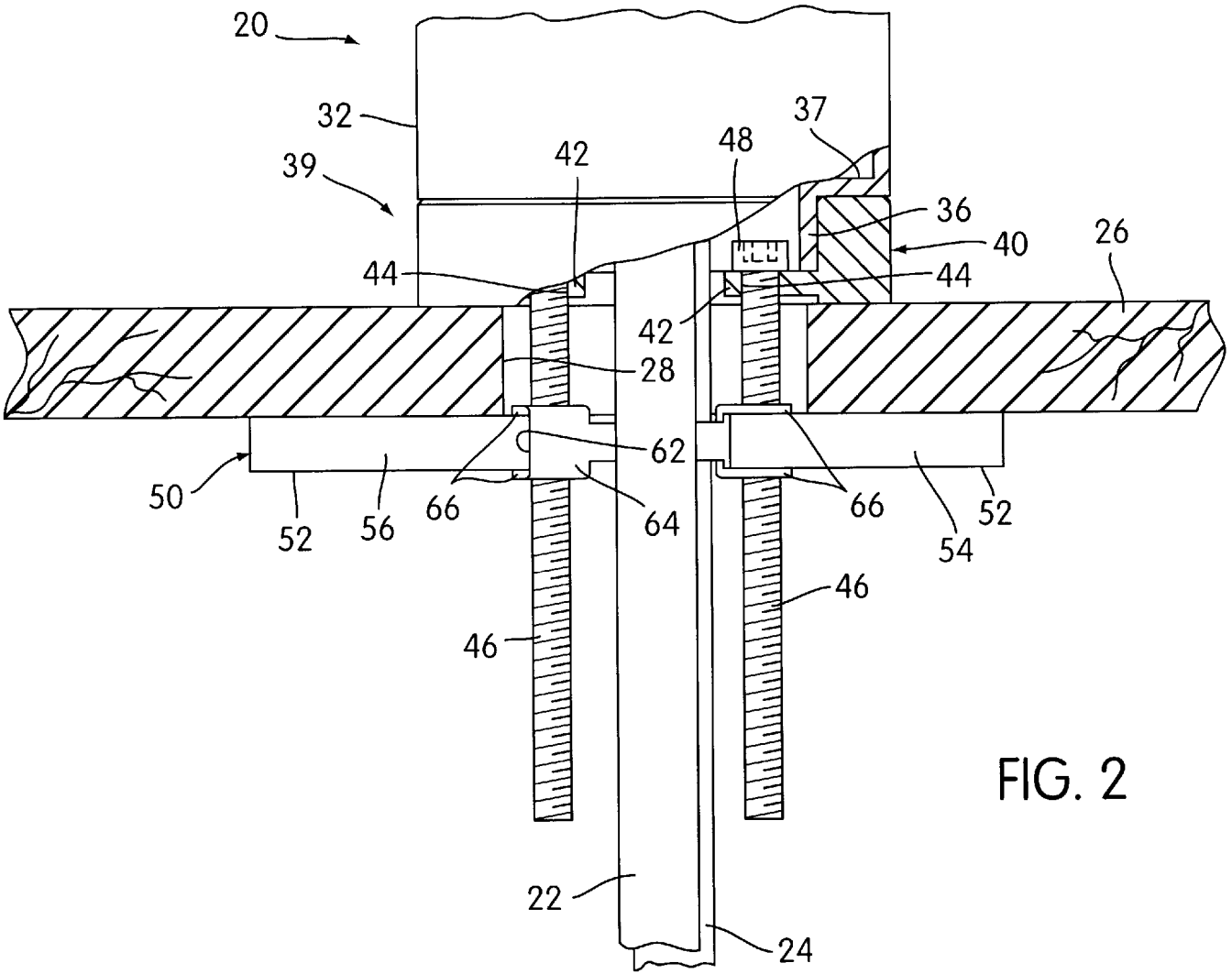
FIG. 2 is a partial sectional front elevational view of the first embodiment of the quick-install assembly according to the principles of the present invention.
Figure 3:
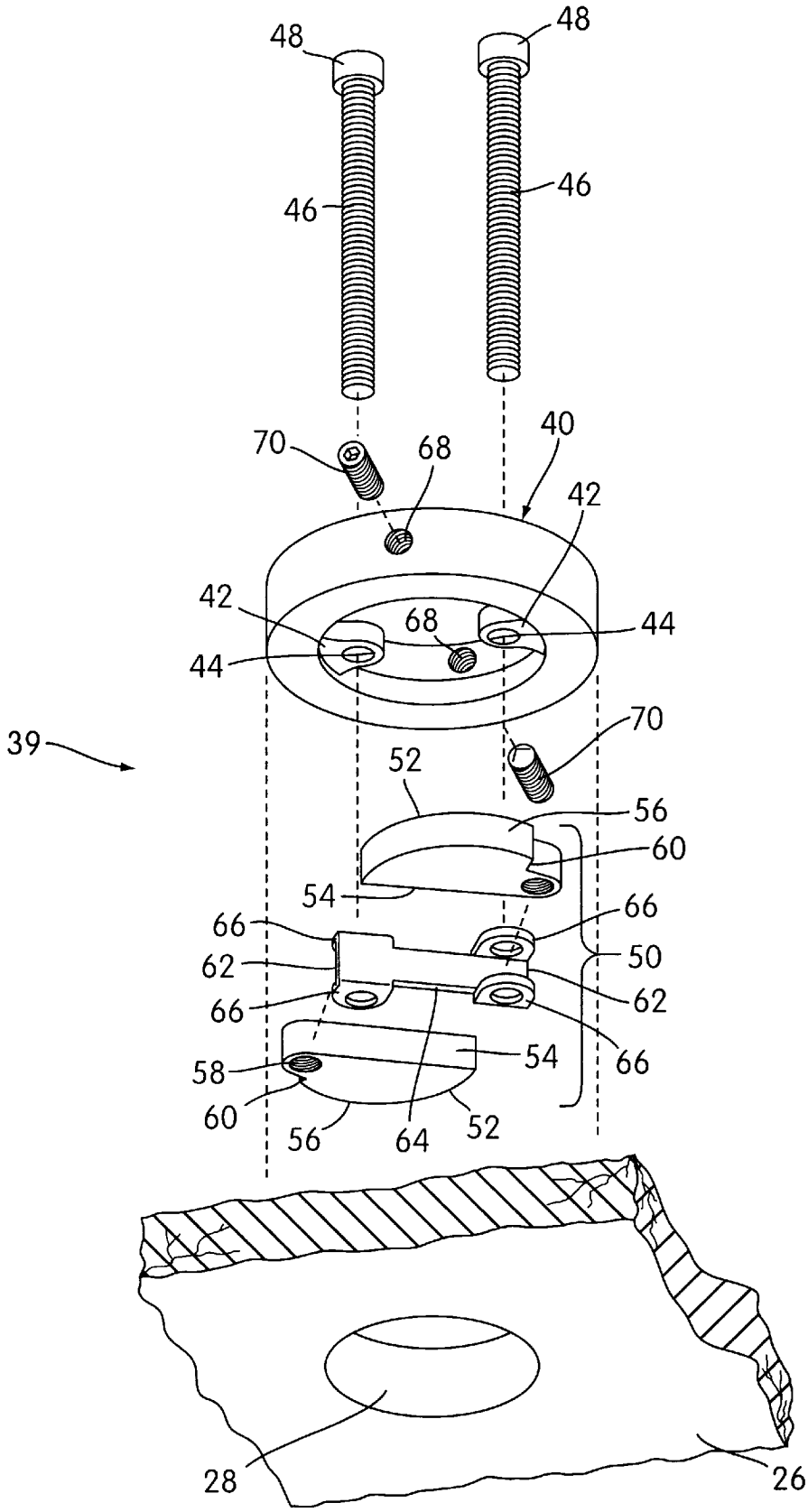
FIG. 3 is an exploded perspective view of the quick-install assembly, absent the faucet, before it is connected to the deck.
Figure 4:
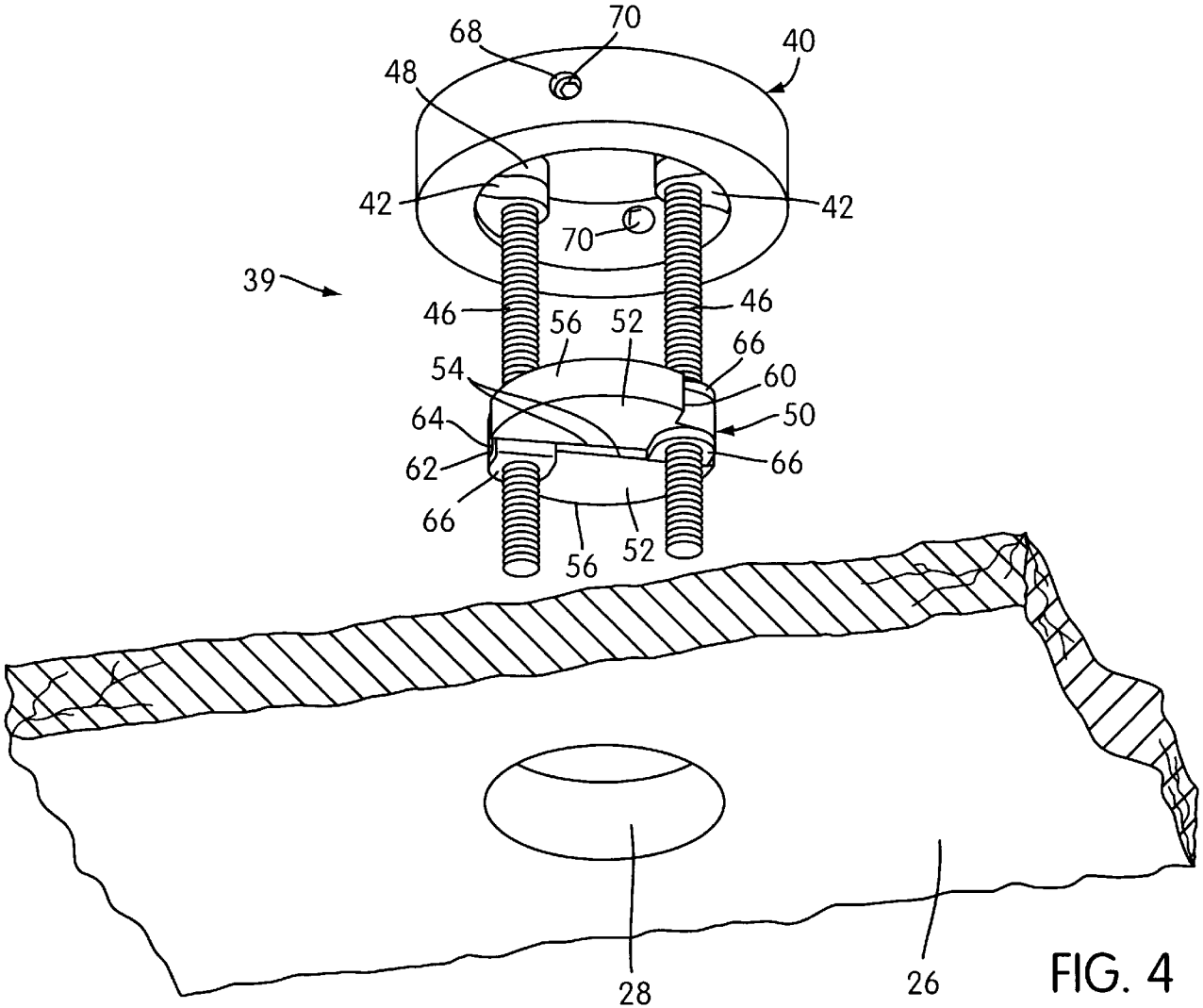
FIG. 4 is a perspective view of the quick-install assembly with the swing flaps in closed position and above the deck, absent the faucet.
Figure 5:
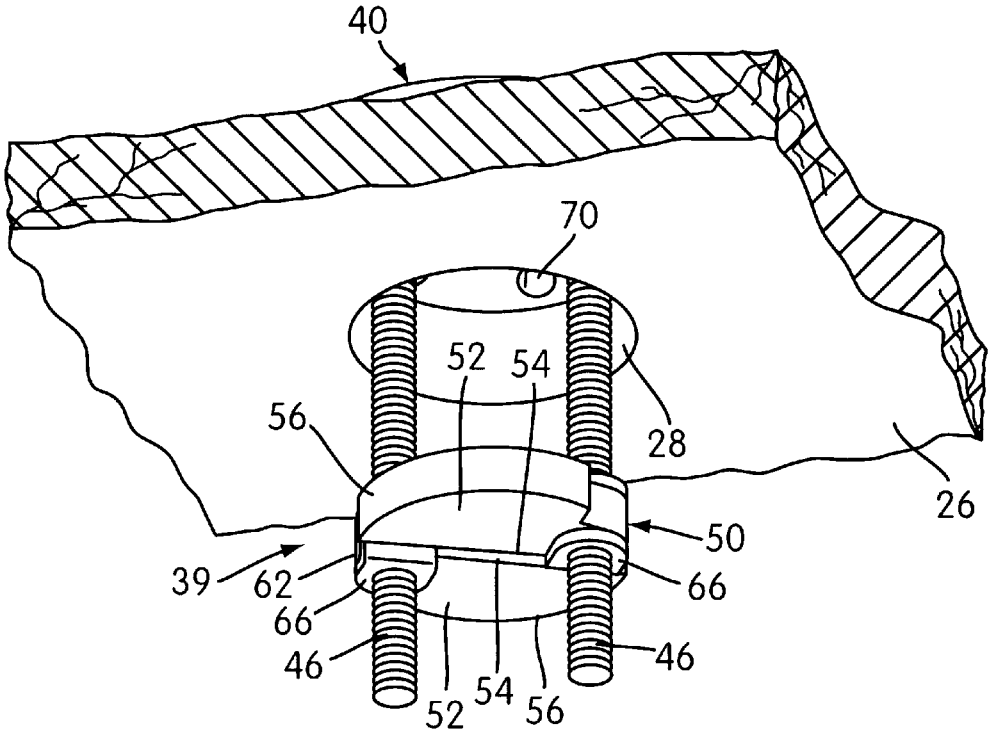
FIG. 5 is a perspective view of the quick-install assembly viewed from below the deck and after it has been inserted in the deck, and before it has been connected thereto.

With reference to the accompanying drawings, the first embodiment of the invention is shown in FIGS. 1 through 11, wherein a single control faucet 20 is illustrated in FIG. 1 and is adapted to have water supply lines 22 and 24 for hot and cold water respectively connected thereto, as shown in FIGS. 1 and 2, which connection may conveniently be made above a deck 26 after the water supply lines 22 and 24 have passed through an opening 28, shown best in FIGS. 3, 4 and 5, to be sealingly connected to a water valve (not shown) mounted in a housing 30 of the faucet 20. The housing 30 is mounted above a hub 32 and a single control handle 35 is connected atop the housing 30. The hub 32 has a spout 34 connected to extend outwardly therefrom.

In the faucet 20 illustrated in the drawings, the spout 34 will retain a single fixed position, but the faucet 20 or the housing 30, or the hub 32 could easily be modified to provide for the spout 34 to be shiftable, and also may include a pull-out feature, as desired. Water will be delivered to the faucet 20 through the water supply lines 22 and 24 to be suitably mixed in the water valve (not shown) that is controlled by the handle 35 for discharge from the spout 34 in a conventional manner.

Figure 10:
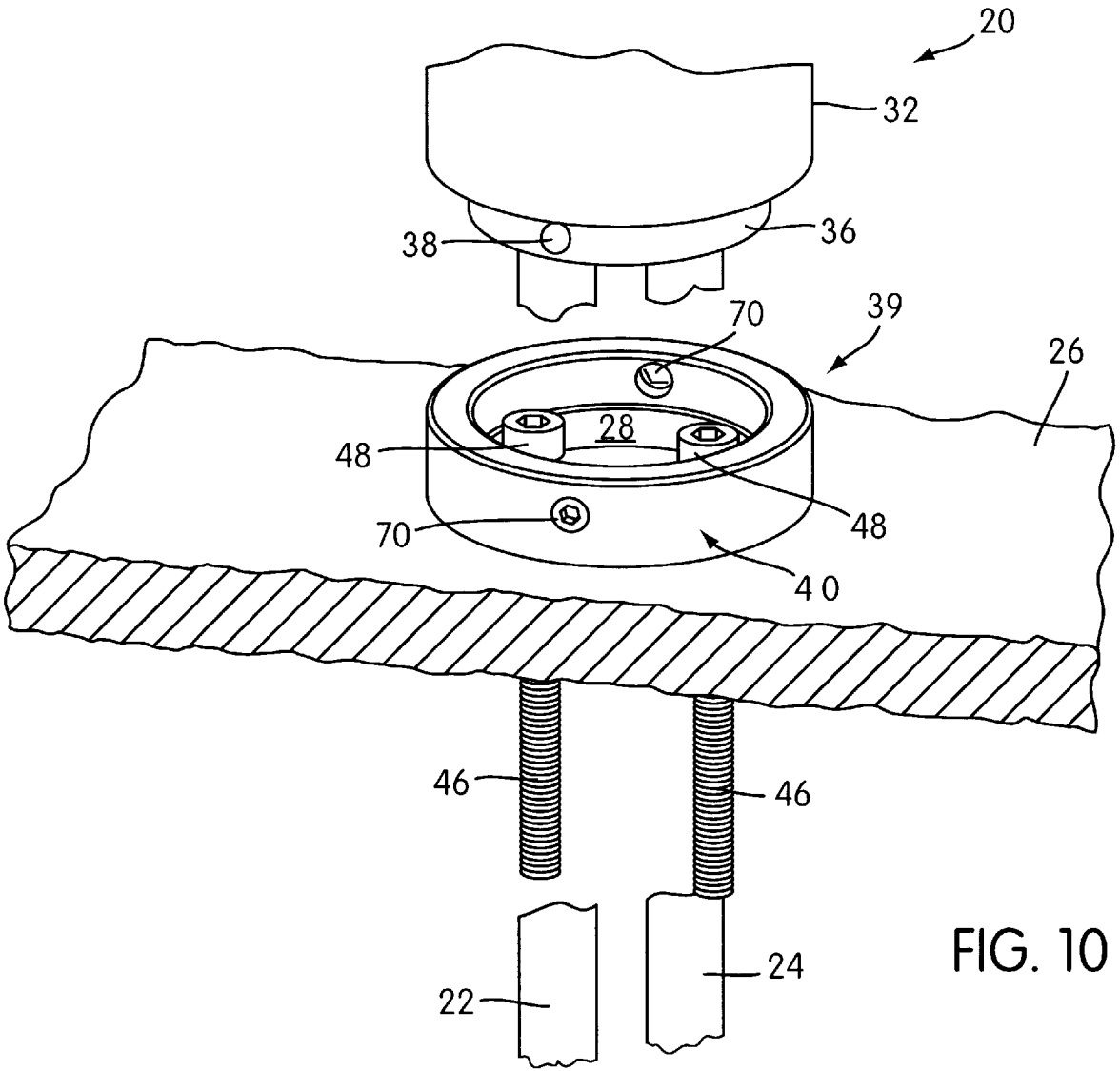
FIG. 10 is an exploded perspective view of the quick-install assembly connected to the deck and before the faucet is connected to the quick-install assembly.

The hub 32 is formed with a diameter substantially equal to the diameter of the housing 30. A lower section 36 of reduced diameter extends vertically downwardly from an annular horizontal flange 37 of the hub 32, as shown best in FIG. 2. A pair of small circular recesses 38, only one of which is shown in FIGS. 1 and 10, are formed on the outer surface of the lower section 36 to extend inwardly toward each other from diametrically opposed locations for purposes more fully explained hereinafter.

In the first embodiment of the present invention, the quick-install assembly 39 illustrated in FIGS. 1 through 11 has an annular collar 40 of slightly larger diameter than the opening 28 of the deck 26, which collar 40 may be placed on the upper surface of the deck 26 about the opening 28. The inner diameter of the collar 40 is sized to receive the lower section 36 of the hub 32. The annular flange 37 sits upon the upper surface of the collar 40 and the outer vertical surface provides a smooth one surface transition from collar 40 to hub 32 to housing 30.

The collar 40 has a pair of ears 42, 42 that extend from the inner diameter toward each other a short distance and have apertures 44, 44 formed therein through which fasteners, such as bolts 46, 46, are disposed in non-threaded engagement. The bolts 46, 46 have enlarged heads 48, 48 that nest upon the ears 42, 42. The heads 48, 48 have hexagonal openings which are adapted to receive allen wrenches to turn the same, though the opening could have been slotted or any other conventional drive connector.

A retainer 50 having a pair of swing flaps 52, 52 that are semi-circular bodies with the straight sides 54, 54 facing each other and the circular sides 56, 56 facing away from each other. At opposite ends are threaded openings 58, 58, shown best in FIG. 3, to which the bolts 46, 46 are threadedly engaged to axially shift the retainer 50 up and down the bolts 46, 46 and to pivot the swing flaps 52, 52 between an open position, shown in FIGS. 8 and 9, and a closed position, shown in FIGS. 5 and 6. In the open position, a shoulder notch 60, 60 engages the outer end 62, 62 of a strap 64 to prevent further pivotal movement of the swing flaps 52, 52 and, thereafter, cause the swing flaps 52, 52 to be axially shifted upwardly in the direction of the deck 26. The strap 64 has two pair of outwardly facing horizontally disposed ears 66, 66 that straddle the swing flaps 52, 52 adjacent the threaded openings 58, 58. Each pair of ears 66, 66 has apertures therein through which the bolts 46, 46 pass and, since the apertures are slightly larger in diameter, no threaded engagement will occur. Thus, the strap 64 acts to keep each of the swing flaps 52, 52 connected in the retainer 50 and in the same horizontal plane.

Figure 6:
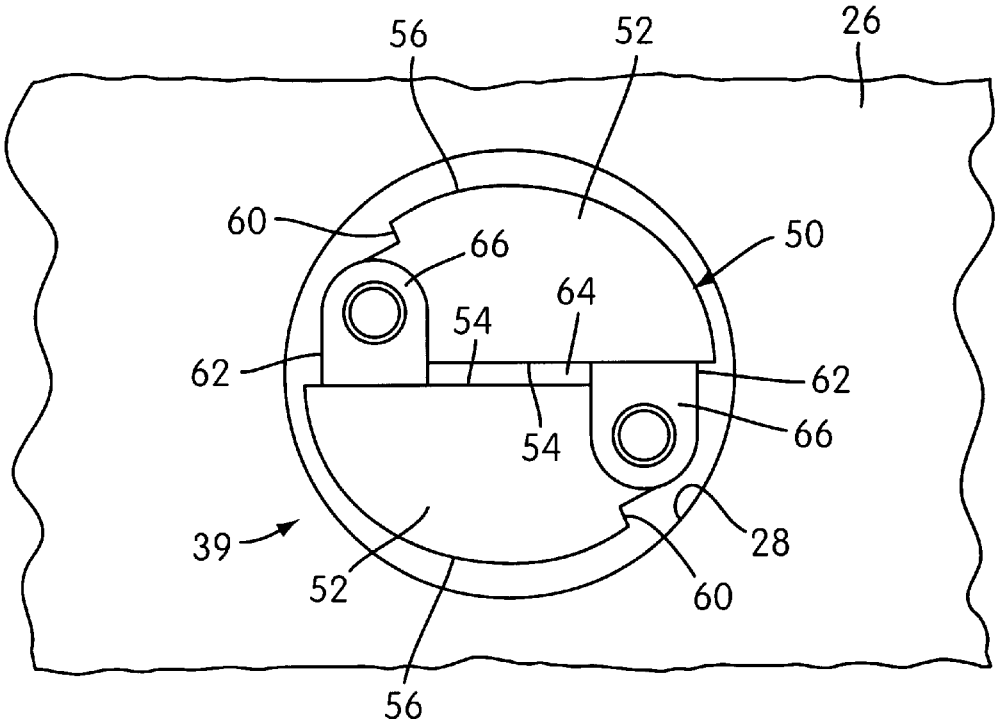
FIG. 6 is a bottom plan view looking upwardly of the quick-install assembly of FIG. 5.
Figure 7:
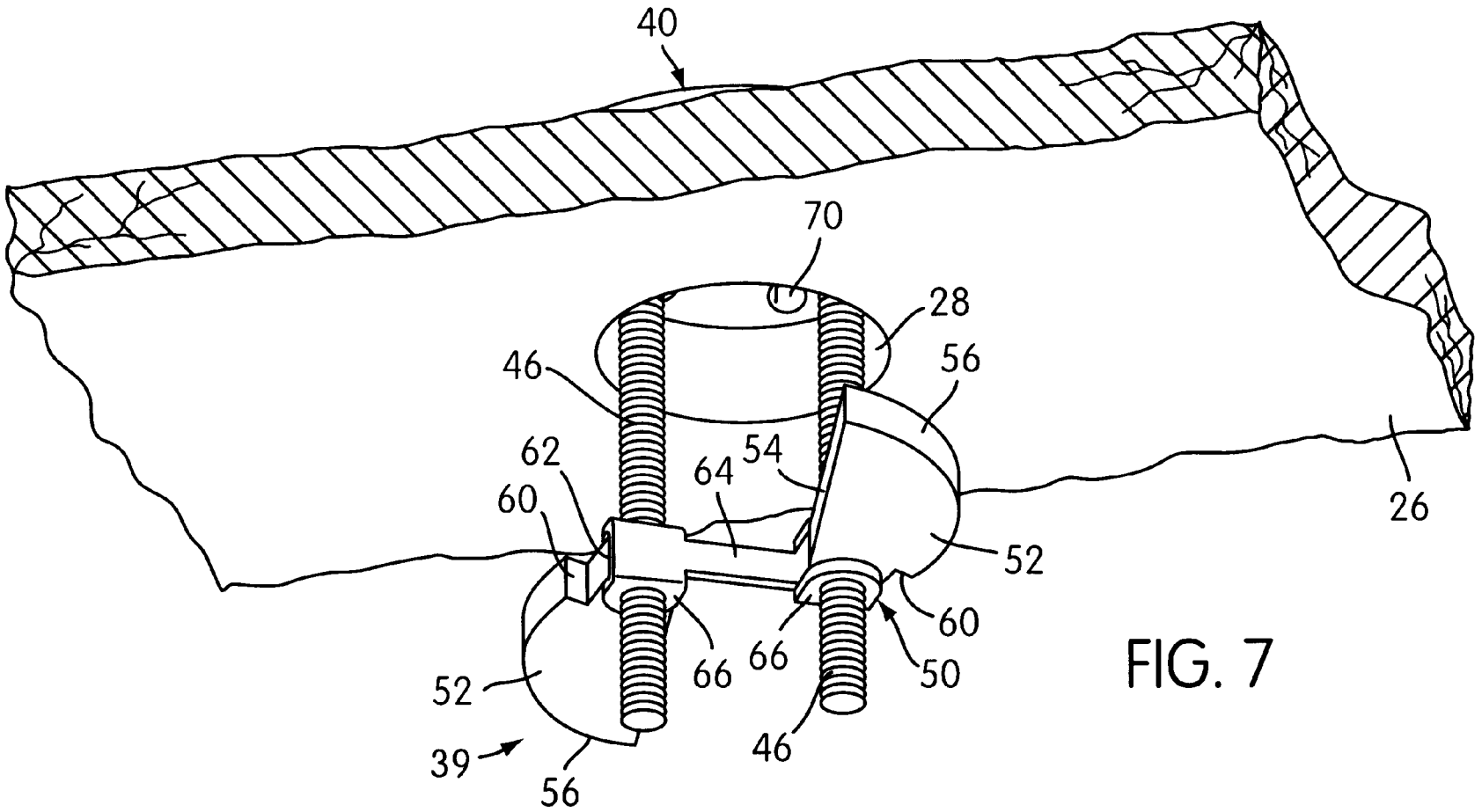
FIG. 7 is a perspective view of the quick-install assembly viewed from below the deck with the swing flaps in the partially open position.
Figure 8:
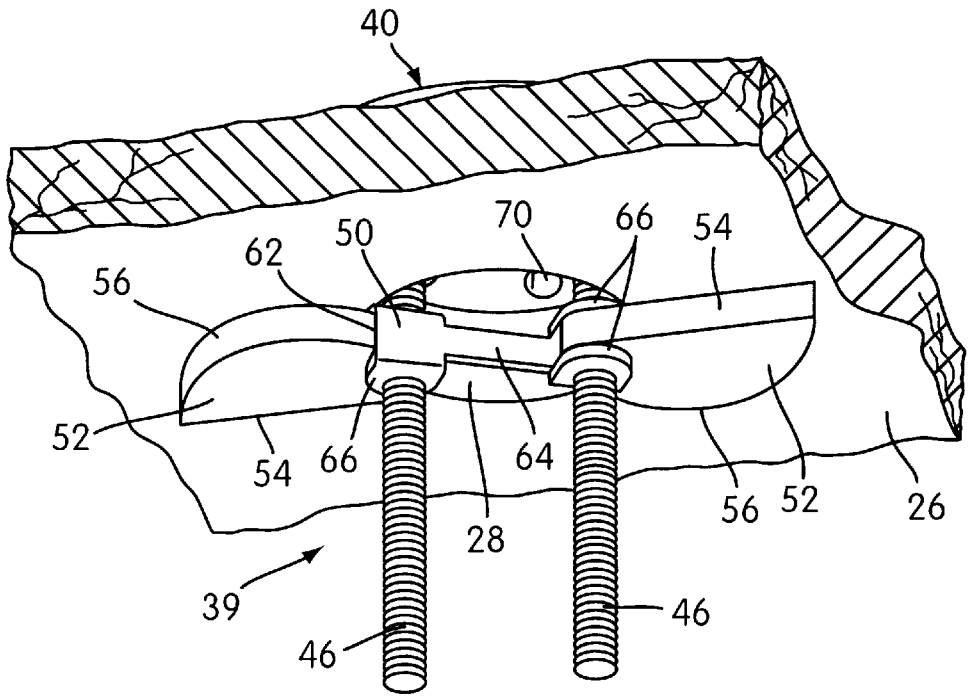
FIG. 8 is a perspective view of the quick-install assembly viewed from below the deck and with the swing flaps in the open position and connected to the deck.
Figure 9:
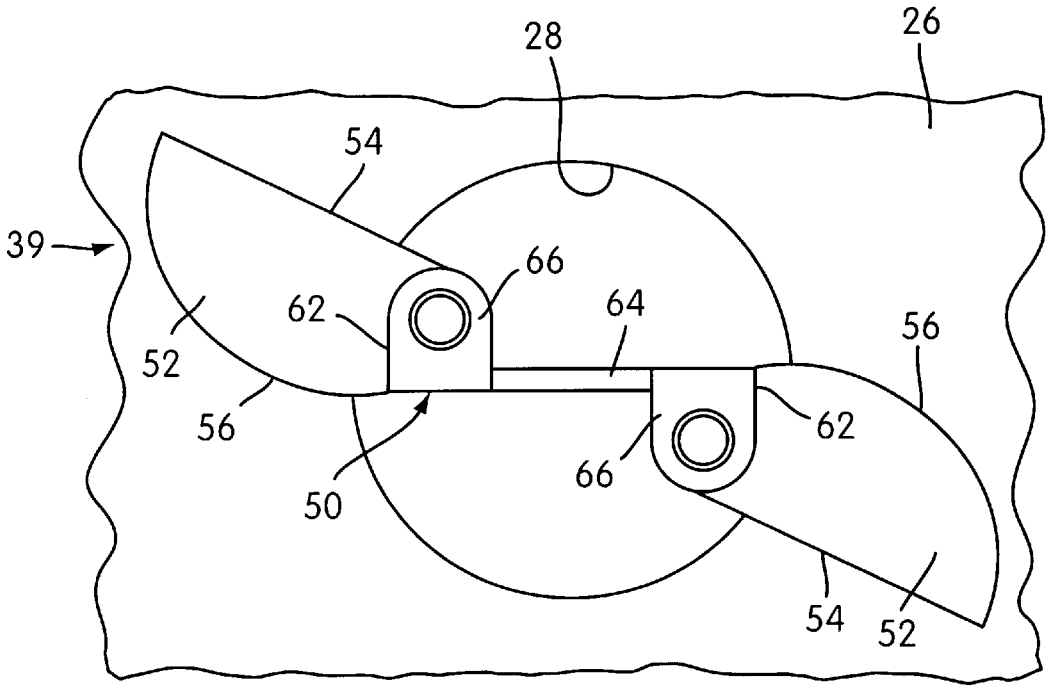
FIG. 9 is a bottom plan view looking upwardly of the quick-install assembly of FIG. 8.

Whenever it is desired to connect the quick-install assembly 39 to the deck 26, the bolts 46, 46 will be connected to the ears 42, 42 and the swing flaps 52, 52 mounted to the strap 64 and threadedly connected to the bolts 46, 46 in the closed position, as shown in FIG. 4, to be passed into the opening 28 of the deck 26 to place the collar 40 upon the deck 26 and about the opening 28 therein, as shown in FIGS. 5 and 6. The swing flaps 52, 52 are in the closed position and threadedly connected to the bolts 46, 46 a short distance from the deck 26. The bolts will now be engaged by a suitable tool, such as an alien wrench, and rotated (assume) in a clockwise direction to cause the swing flaps 52, 52 to pivot outwardly, as shown in FIG. 7. The rotation of the bolts 46, 46 will continue to bring the swing flaps 52, 52 into the open position with the shoulder notches 60, 60 contacting the ends 62, 62 of the strap 64. Continued rotation of the bolts 46, 46 forces the swing flaps 52, 52 to be axially shifted upwardly into clamping engagement with the underside of the deck 26, as shown in FIGS. 8 and 9, while the collar 40 is in clamping engagement with the upper side of the deck 26. The quick-install assembly 39 contacts the upper side and underside of the deck 26 along a substantial area so as to be solidly secured to the deck 26. Thereafter, the water supply lines 22 and 24 will be passed upwardly through the opening 28 of the deck 26 to be sealingly connected into the faucet 20.

Figure 11:
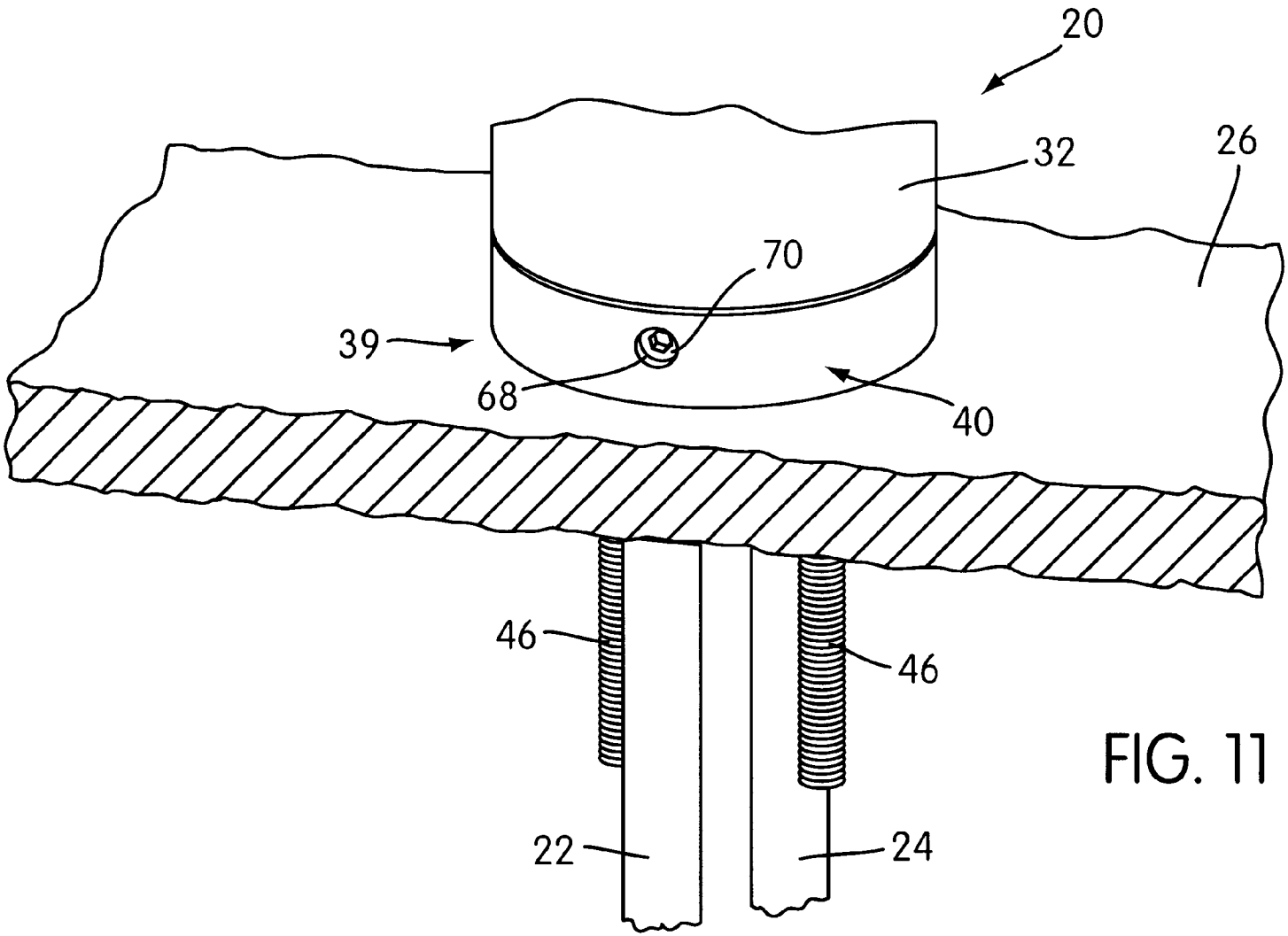
FIG. 11 is a perspective view of the quick-install assembly to which the faucet is connected.

The hub 32 of the faucet 20 will have the recesses 38, 38 aligned with tapped holes 68, 68, shown in FIGS. 3 and 10, and into which are mounted set screws 70, 70 so that, on placing the lower section 36 within the inner diameter of the collar 40, the set screws 70, 70 will be connected into the recesses 38, 38 to lock the faucet 20 to the quick-install assembly 39 and mount the faucet to the deck 26, as shown in FIG. 11.

Figure 12:
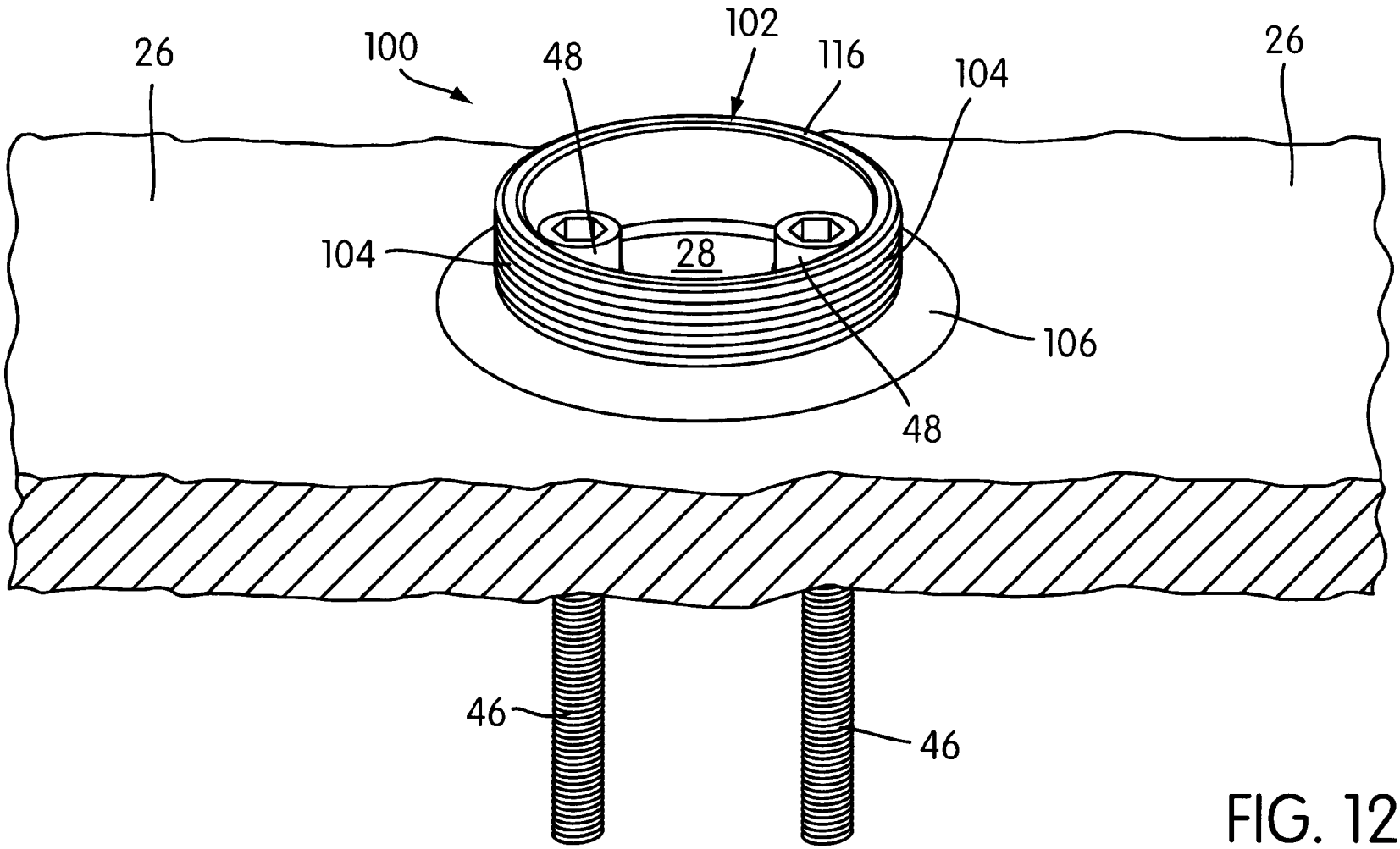
FIG. 12 is a perspective view of a second embodiment of the quick-install assembly of the present invention absent the faucet.
Figure 13:
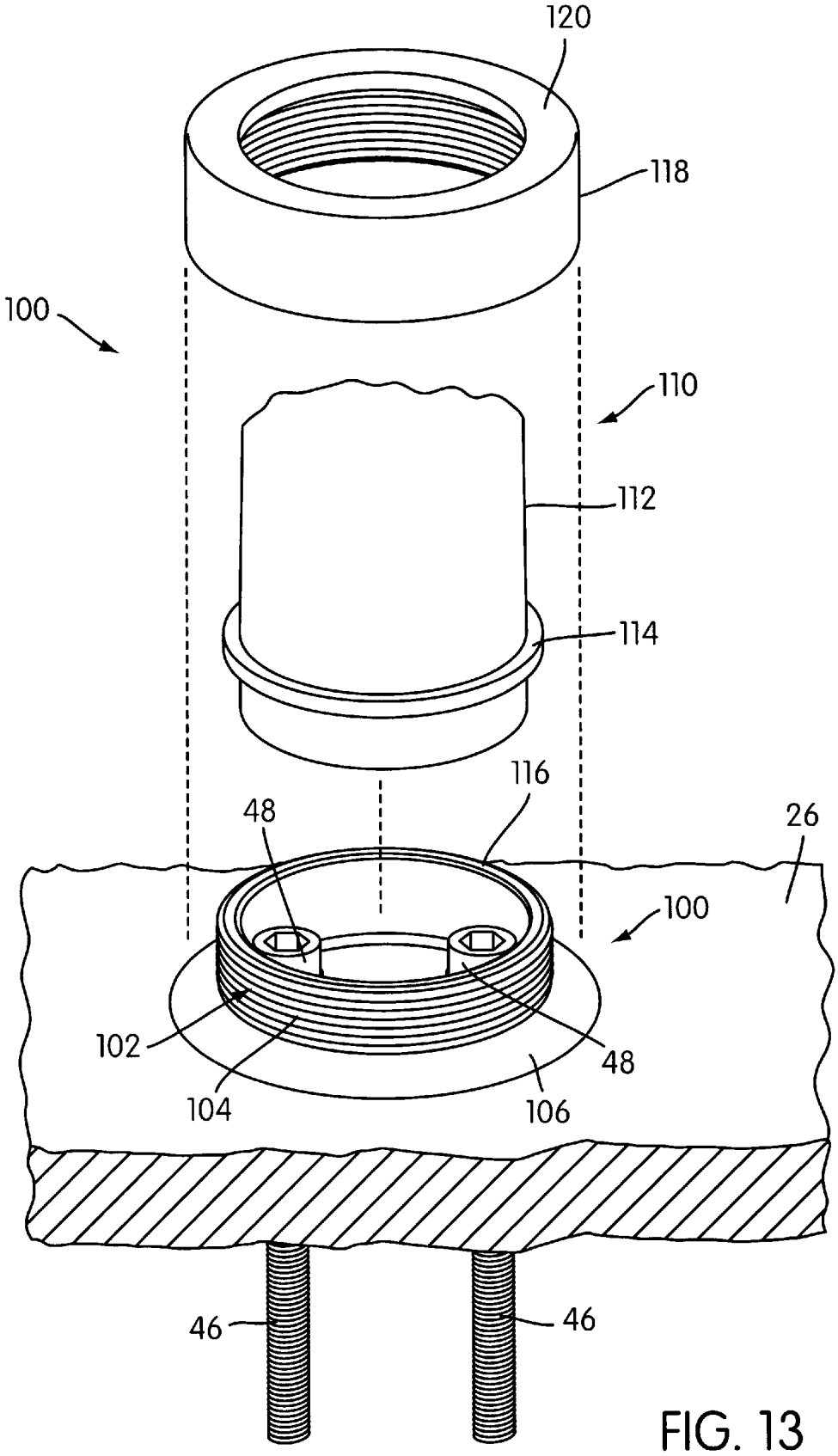
FIG. 13 is an exploded perspective view of FIG. 12 with the faucet about to be connected to the quick-install assembly.
Figure 14:
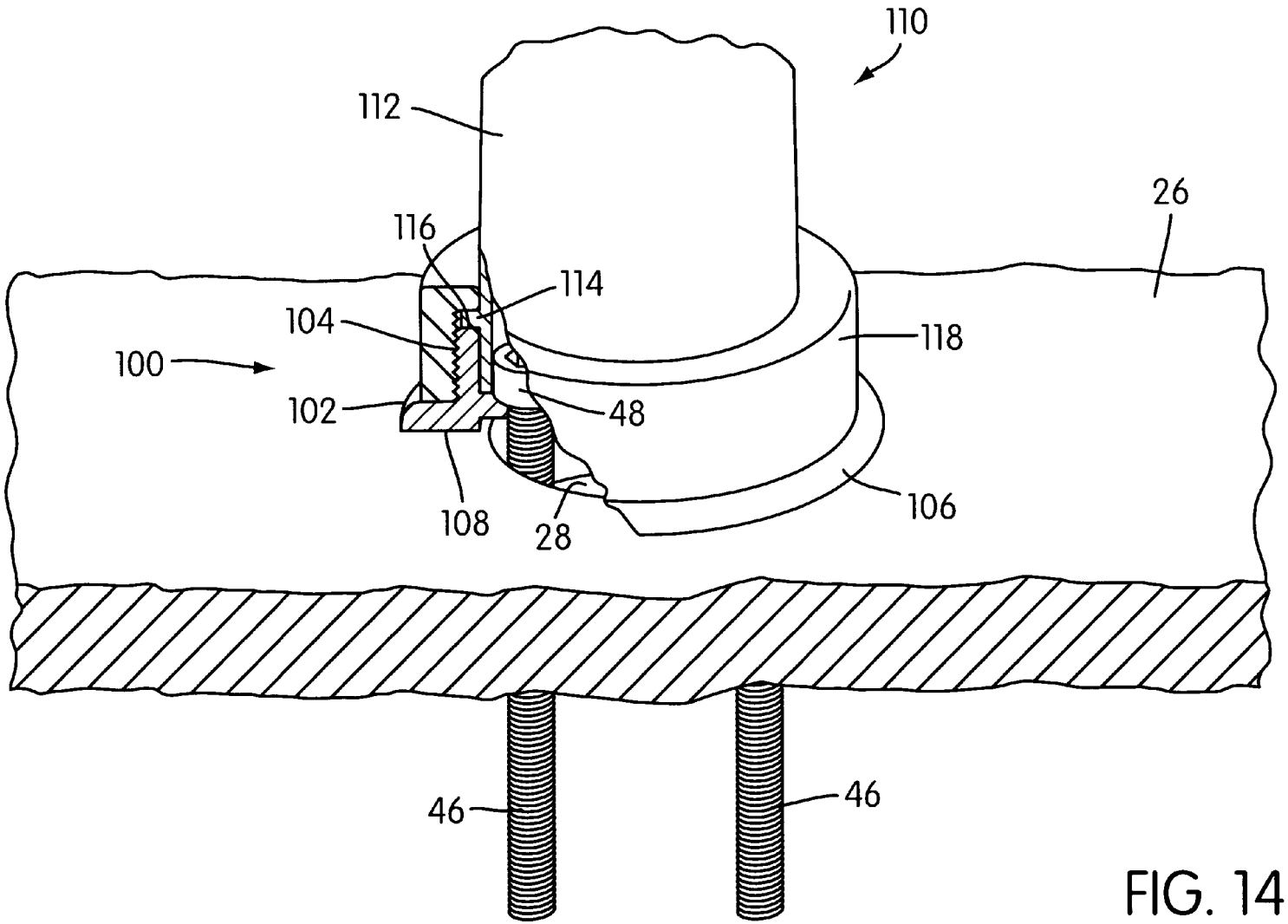
FIG. 14 is a perspective view, partly in section and cut away, of the second embodiment of the present invention after the faucet has been connected to the quick-install assembly.

With reference to the second embodiment of the present invention, this embodiment is illustrated in FIGS. 12, 13 and 14, wherein components that are similar or identical to those shown and described in the first embodiment will have the same reference characters and those components which, though achieving the same results, are substantially different, will have different reference characters. Accordingly, the second embodiment has a quick-install assembly 100 in which a collar 102 has threaded section 104 on its external vertical outer surface and an annular flange 106 at the bottom 108 that will surround the opening 28 of the deck 26, as shown best in FIG. 14. The collar 102 of the second embodiment is similar in function as the collar 40 of the first embodiment and has similar internal ears 48 through which bolts 46, 46 having heads 48, 48 are connected to extend therethrough.

A faucet 110, shown in part in FIGS. 13 and 14, has a housing hub 112 with an annular clamping flange 114 formed adjacent its lower end will be mounted on the top end 116 of the collar 102 and about which an internally threaded clamping ring 118 having an inwardly extending annular flange 120 that engages and clamps upon the clamping flange 114 upon the clamping ring 118 being threadedly connected to the threaded section 104 of the collar 102. FIG. 13 shows the connecting components about to be clampingly connected to each other and FIG. 14 shows the components after they have been clamped together. Of course, the collar 102 and the quick-install assembly 100 have first been mounted to the deck 26 in a similar manner as that of the quick-install assembly 39. Thereafter, the faucet 100 is clampingly connected to the quick-install assembly 100, as best shown in FIG. 14. Regardless of which quick-install assembly 39 or 100 is used, the present invention provides for the faucet 20 and/or 110 to be suitably mounted to the deck 26.

Disassembly of the faucets 20 and 100 is as quick and easy as assembly thereof by reversing the step taken to assemble the same to the deck 26. In the first embodiment, the set screws 70, 70 will be loosened to permit the faucet 20 to be removed and then the bolts 46, 46 will be rotated (assume) counter-clockwise to loosen the clamped position and change the position of the swing clamps 52, 52 from open to closed, which will permit the quick-install assembly 39 to be removed from the deck 26, as desired. All of the necessary operations are completed above the deck 26.

In the second embodiment, the disassembly is accomplished by first unscrewing the clamping ring 118 from the collar 102 and, thereafter, removing the faucet 110 from the collar 102. The quick-install assembly 100 may then be removed from the deck 26 in the same manner as that of the quick-install assembly 39.

In general, the above-identified embodiments are not to be construed as limiting the breadth of the present invention. As stated earlier, modifications or other alternative constructions will be apparent which are within the scope of the invention as defined in the appended claims.

What is claimed is:

1. A quick-install assembly for a faucet connected to water supply lines that extend through an opening in a deck to which the faucet will be mounted, comprising:

a. a collar adapted to be positioned from above the deck about the opening of the deck;

b. a pair of ears formed on the interior of the collar;

c. a pair of fasteners operatively adapted to be engaged from above the deck and connected to the ears at a smaller diameter than the diameter of the opening of the deck to be disposed from above through the opening of the deck;

d. a retainer threadedly connected to the fasteners and having a pair of swing flaps thereon adapted to be axially shifted toward and away from the collar responsive to the direction of rotation of the fasteners;

e. the pair of swing flaps rotate on the fasteners between a closed position that provides a small dimension that passes through the opening of the deck and an open position that provides a long dimension with each swing flap pivoted outwardly so that when the retainer is disposed below the deck and the retainer is shifted upwardly, each of the swing flaps will clamp against the underside of the deck to clamp the quick-install assembly thereto; and f. connecting means operable from above the deck to connect the faucet to the collar whereby the faucet will be mounted upon the deck.

2. The quick-install assembly as claimed in claim 1 wherein:

a. the connecting means define a pair of set screws that are threadedly connected to extend through the collar to lockingly engage the faucet.

3. The quick-install assembly as claimed in claim 1 wherein:

a. the collar has threads on its external surface;

b. a connecting ring having a threaded internal surface to threadedly engage the threads on the external surface of the collar and clamp the connecting ring to the collar;

c. a plurality of flanges to interlock the faucet and the connecting ring to each other whereby on clamping the connecting ring to the collar, the faucet will be mounted to the deck.

4. The quick-install assembly as claimed in claim 1 wherein:

a. the pair of swing flaps connected to the fasteners, one to each fastener;

b. the pair of swing flaps in the closed position permit the retainer to pass into and through the opening in the deck whereby, on turning of the fastener, the swing flaps pivot to the open position which is outwardly beyond the opening on the deck to contact and clamp against the underside of the deck and lock the collar to the deck above the opening therein.

5. The quick-install assembly as claimed in claim 4 wherein:

a. the retainer includes a strap extend between the fasteners and to which is connected the pair of swing flaps that pivot on the strap, responsive to the fasteners between the closed position and the open position.

6. The quick-install assembly as claimed in claim 5 wherein:

a. the strap is smaller than the diameter of the opening in the deck to permit easy passage of the retainer therethrough;

b. a pair of oppositely facing ears are formed on the strap;

c. the swing flaps are connected to the ears by the fasteners, one to each ear on opposite sides of the strap;

d. the swing flaps pivot about the ears between the closed position and the open position responsive to the rotation of the fasteners.

7. The quick-install assembly as claimed in claim 6 wherein:

a. each of the swing flaps has a shoulder notch formed adjacent the each of the straps to which it is connected so that, in the closed position, the shoulder notch remains remote from the strap and, in the open position, the shoulder notch engages the strap to limit the pivotal motion of the swing flap.

8. The quick-install assembly as claimed in claim 1 wherein:

a. the swing flaps pivot outwardly and inwardly responsive to the rotation of the fasteners between the open position and the closed position.

9. The quick-install assembly as claimed in claim 8 wherein:

a. the retainer has a strap to which each of the swing flaps are connected to and at opposite ends of the strap;

b. each of the swing flaps has a shoulder notch to engage the strap in the open position to prevent further movement of the swing flap.

10. The quick-install assembly as claimed in claim 9 wherein:

a. the collar has a larger diameter than the diameter of the opening of the deck and is disposed upon the upper side of the deck about the opening therein.

* * * * *